United States Patent [19]

Redmond

[11] Patent Number: 4,700,532

[45] Date of Patent: Oct. 20, 1987

[54] METHOD AND APPARATUS FOR MAKING COMPACT PACKAGES FOR SPREADABLE PRODUCTS

[76] Inventor: Sanford Redmond, 746 Riverbank Rd., Stamford, Conn. 06903

[21] Appl. No.: 915,182

[22] Filed: Oct. 3, 1986

[51] Int. Cl.[4] ..... B65B 3/02

[52] U.S. Cl. ..... 53/452; 53/457; 53/564; 53/519

[58] Field of Search ..... 53/122, 378, 519, 435, 53/452, 456, 453, 462, 466, 559, 563, 221, 228, 564, 457; 493/355, 356, 399, 409, 410

[56] References Cited

U.S. PATENT DOCUMENTS

| | | | |
|---|---|---|---|
| 3,129,546 | 4/1964 | Redmond | 53/122 |
| 3,345,795 | 10/1967 | Anderson | 53/122 X |
| 3,631,652 | 1/1972 | Redmond | 53/529 |
| 4,449,350 | 5/1984 | Redmond | 53/426 X |
| 4,633,651 | 1/1987 | Edmunds | 53/519 X |

FOREIGN PATENT DOCUMENTS

| | | | |
|---|---|---|---|
| 733201 | 7/1955 | United Kingdom | 53/435 |

*Primary Examiner*—Robert L. Spruill
*Assistant Examiner*—Steven P. Weihrouch
*Attorney, Agent, or Firm*—Morgan & Finnegan

[57] ABSTRACT

Method and apparatus for making compact packages for spreadable products wherein base cards are cut from a supply of relatively stiff material, scored and bent into the shape of a channel, the channel then reopened and substantially flattened, and a portion of spreadable product is thereafter deposited onto each pre-bent base card between the score lines. Top sheet material is drawn from a supply of relatively flexible material, scored parallel to each edge, and then folded under the material web, compressed to form a crease at the fold line, and then reopened to a relatively flat position. After passing through draw rollers, the creased top sheet material is cut into individual creased sheets which are accelerated forward with a speed coinciding with the speed of movement of the base card carrying the spreadable product and thereupon deposited in centered alignment onto the aforesaid spreadable product, whereupon the sheet is rolled into adhering contact with the top surface of the spreadable product while simultaneously bending the sides of the creased sheet into a channel shape and pressing the channel sides into adhering contact with the sides of the product. The sides of the bottom card are then raised and formed into their final position, which is also channel-shaped, and both the top and bottom channel sides are pressed into overlapping abutting contact with each other and with the sides of the spreadable product encased therebetween.

17 Claims, 26 Drawing Figures

METHOD AND APPARATUS FOR MAKING COMPACT PACKAGES FOR SPREADABLE PRODUCTS

RELATED PATENTS

The method and apparatus for manufacturing packages for individual service portions of a spreadable product disclosed in this application represent an improvement over the package structure and methods and apparatus for manufacturing same, disclosed in Redmond U.S. Pat. No. 3,129,546, issued Apr. 21, 1964, U.S. Pat. No. 3,631,652, issued Jan. 4, 1972, and U.S. Pat. No. 4,449,350, issued May 22, 1984, the disclosures of which are hereby incorporated by reference.

Also on Apr. 30, 1985, Applicant filed U.S. application Ser. No. 729,050 directed to the specific configuration and structure of the package produced by the method and apparatus described herein, the disclosure of which is also hereby incorporated by reference.

BACKGROUND AND OBJECTS OF THE INVENTION

1. Field of the Invention.

The present invention relates to the manufacture of a multiplicity of packages for an individual service portion of a spreadable product and, more specifically, to certain new and useful improvements in the method and apparatus for manufacturing such packages.

2. Description of the Prior Art.

Prior to the 1960's, portioned butter (margarine was then a minimal factor in food service) was pre-packaged, sold to and used by the great majority of foodservice establishments in small rectangles, called "pats", generally embossed with the insignia of the producer or, in the instance of large chain consumers, with the consumer's own logo.

At that time, it was the practice of foodservice establishments such as hospitals, cafeterias, government institutions, airlines, railroads and the like, to place the individual butter pats on small individual pieces rectangular paperboard, approximately two inches square, bent upwards at a shallow angle on all four sides, called butter "chips", just prior to each meal. The cost at that time for the paperboard "chips", butter pats and labor ran on the order of five cents per pound (at present rates adjusted for inflation this might represent 20 to 30 cents per pound, a very significant number, to which could be added the cost of Producing the pats as well as the packaging materials for the loose butter pats).

In response to the need to automate the entire aforesaid process, Applicant was granted the aforementioned U.S. Pat. No. 3,129,546 for a machine which produced approximately 1,500 individual portion packages per minute, including forming the individual rectangular butter pats, placing the pats on the paperboard chips and also placing a small piece of parchment paper on the top of each pat. The paperboard chips used in the patented machine were made in an approximate two inch square and bent upwards at a shallow angle along two edges to simulate the aforesaid handmade packages. The paper covering each butter pat had the dual function of providing a degree of protection for the butter against contamination by dirt, dust or other airborne particles and, more importantly, permitted the pats to be stacked one on top of the other. Applicant also was granted the aforesaid U.S. Pat. No. 3,651,652, directed to improvements to the machine described in the U.S. Pat. No. 3,129,546, including means for automatically counting and loading the pats into trays (known as "boats") and delivering them to an operator for loading into shipping containers.

Butter pats produced by the aforesaid Redmond patented machines and in the aforesaid configuration were extremely successful and have been a staple article of commerce for a number of years. However, despite their enormous commercial success, the aforesaid packages suffered the disadvantage that they were open on four sides, permitting the passage of air about the butter, and thus could become contaminated by dirt, bacteria or the like. Also, these packages could be produced on a misadjusted machine and with inferior materials, and therefore could be bf poor quality and sloppy appearance.

Various alternative package structures have since been developed in which the butter is completely enclosed, such as placing the butter in a cup or "tub" covered over with a foil-like top, or completely wrapping the butter in foil. However, these packages have suffered other drawbacks in that the materials from which they are made are expensive, their production is slow (on the order of 500/minute), and the equipment required for making them is expensive, unwieldy and complicated. Moreover, these packages are difficult to open and the butter is difficult to remove from the package, invariably resulting in greasy fingers and/or wasted product.

Applicant also was recently granted the aforesaid U.S. Pat. No. 4,449,350 directed to a method and apparatus for manufacturing a further alternative structure, providing a sealed butter pat package which also could be manufactured at the same high speed as his original package, but in which the butter pat continued to be centered on an approximate two inch square base or "chip". In this package, upon folding the cover into a three-dimensional shape a pleat is formed which extends over an edge of the base to permit the cover member to be grasped and peeled from both the margins of the base, to which it is peelably adhered, and the butter pat.

Applicant has now discovered a new and novel method and apparatus for manufacturing a novel and greatly improved package configuration which accomplishes a number of advantages and benefits over the aforesaid handmade butter pat packages and Applicant's own previously patented automatically produced packages, as well as over the various other configurations for sealed butter pat packages.

3. Objects of the invention.

It is therefore an object of this invention to provide a new and improved method and apparatus for automatically producing rigid uniized individual service portion packages of butter or a similar product.

A further object of this invention is to provide a new and improved method and apparatus for automatically producing rigid unitized individual service portion packages of butter or a similar product wherein the package is formed of three members, comprising a channel-shaped top cover, the product itself and a channel-shaped bottom, the top and bottom channels being in adhering contact with the encased product.

A further object of this invention is to provide a new and improved method and apparatus for automatically producing the aforesaid rigid unitized packages substantially enclosing an adhered to a rectangular pat of butter or similar product at high speed and yet with improved quality and consistency in the appearance of the package.

A further object of this invention is to provide a new and improved method and apparatus for automatically producing the aforesaid rigid unitized packages of butter or a similar product in which novel feeding, scoring and forming means sharply and accurately define the corners of the channel members forming the package so as to impart a crisp and clean appearance to the finished package.

A further object of this invention is to provide a new and improved method and apparatus for automatically producing the aforesaid rigid unitized packages of butter or a similar product wherein the package is comprised of upper and lower channel-shaped members in opposed alignment above and below the enclosed product in which the opposed channel sides of the top cover are in adhering contact with the top and two opposed sides of the enclosed product and the opposed channel sides of the bottom channel member overlap and abut the outer surfaces of the top cover channel sides and adhere to the bottom and sides of the enclosed product.

A further object of this invention is to provide a new and improved method and apparatus for automatically producing the aforesaid rigid unitized packages of butter or a similar product wherein opposed upper and lower channel members are pre-formed and then reopened to a substantially flat configuration prior to deposit of the pat of product onto the lower channel member and prior to adherence of the upper channel member to the product.

A further object of this invention is to provide a new and improved method and apparatus for automatically producing the aforesaid rigid unitized packages of butter or a similar product in which the package is comprised of a relatively thin upper channel member in adhering contact with the top and at least a portion of two sides of the product and a relatively thick and rigid bottom channel member onto which the product is deposited and whose channel sides adhere to and are in close fitting relationship to the bottom and two sides of the enclosed product and are also in overlapping contacting relationship with the channel sides of the upper channel member, and in which the lengths of the upper and lower channel members preferably extend beyond both sides of the enclosed product not adhered to the channel members to facilitate the handling and use of the package and protection of the product.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps and improvements herein shown and described.

SUMMARY OF THE INVENTION

Briefly described, the present invention is directed to a new and improved method and apparatus for making rigid unitized packages formed from channel members unitized by adherence to four sides of the preferably rectangular product encased by the channel members.

As preferably embodied, the apparatus comprises a bottom channel fabrication section, a pat forming and depositing section, a cover channel fabrication section, a package assembly section, and a tray loading section.

In the bottom channel fabrication section, there is a continuous stock supply of relatively stiff bottom material of predetermined width which will form the bottom channel of the package. The relatively stiff bottom material is continuously cut into bottom cards of predetermined length and the through driven scoring rollers which score the bottom card along two opposed parallel sides. The scored card is then passed through folder-/unfolder means which first bends the scored sides of the card at least beyond 90° to form a channel and thereafter reopens the channel to an approximately flat configuration.

A generally rectangular pat of butter or other product is thereafter deposited onto the pre-bent, substantially flattened bottom card between the score lines. Preferably, the distance between the bottom card score lines is substantially equal to the width of the pat and the length of the card is longer than the pat to provide end margins extending laterally beyond the ends of the deposited pat of product. Thereafter, the conveyor chain assembly continues to transport the pre-bent, substantially flattened bottom card carrying the butter pat or other product toward the package assembly section.

In the cover channel fabrication section, a relatively thin and flexible cover material, preferably paper or "deadfold" foil, which will form the cover channel of the completed package, is continuously drawn from a stock supply through scoring rollers which form a pair of parallel scores in the cover material at a width approximately equal to that of the bottom card score lines. The flexible cover material is then directed through folding and creasing means which fold the scored edges back onto the continuously moving cover material web, compress the folds substantially flat, and thereafter substantially fully unfold them so as to again form the flexible cover material into a substantially flat web containing crease marks along each longitudinal edge. The pre-creased web of flexible cover material then passes through the draw rollers, which drive the material through cutting means and into driven accelerating rollers which slidingly grasp the leading web end. The cover material web is then cut into individual pre-creased sheets of predetermined length and, substantially simultaneously upon being cut, the pre-creased sheet is accelerated forward by the high speed, preferably spring-loaded, rollers which bring the speed of the cover sheets to a speed essentially identical to the speed of the conveyor chain transporting the pre-bent bottom card carrying the product pat. Advantageously, and as preferably embodied, the aforesaid accelerating movement is of such speed and timing to create a space between successively cut individual cover sheets which is identical to the space between the transverse centerlines of two succeeding bottom cards carried by the conveyor chain assembly, to thereby deposit the pre-creased cover sheet symmetrically centered on the pat of product being carried by the bottom card, simultaneously entering the package assembly section.

In the package assembly section, a preferably spring-loaded flanged rolling and tucking spool roller is mounted directly above and in alignment with the top of the product pat. The flexible pre-creased cover sheet passes between the aforesaid spool roller and product pat whereupon the roller rolls the cover material into adhering contact with the top surface of the butter pat and, simultaneously, the spool flanges of the roller bend the pre-creased edges of the cover sheet downwardly and closely adjacent to, and in substantial contact with, two opposed sides of the product pat, thereby forming the cover sheet into channel-shaped longitudinally-extending side pressure rails, preferably shaped similar to the bottom of a ski, thereafter guide and compress the aforesaid channel sides of the cover channel member against and in generally adhering contact with, the sides of the product pat.

After the channel-shaped cover is adhered to the top and two opposed sides of the product, the conveyor chain assembly passes through a pair of opposed longitudinally-extending plow members which raise the pre-scored and pre-bent side edges of the bottom card into a generally upright position to thereby form channel sides which preferably are in substantial adhering contact, or at least close-fitting relationship, with the sides of the butter pat and also are in overlapping relationship with the outer surface of the downwardly extending channel sides of the top cover member. Advantageously, and as preferably embodied, side pressure means, preferably spring-loaded, thereafter press the bottom card channel sides into generally adhering contact with the sides of the product pat and into close fitting overlapping contact with the top cover channel sides. Also advantageously, and as preferably embodied, tamper means finally size and shape the completed package immediately following at the time that the bottom card is formed into a channel shape about the enclosed product and top cover.

Although not forming a part of the present invention, the completed packages preferably are thereafter suitably transported to a loading station, e.g., as shown and described in my aforesaid U.S. Pat. No. 3,631,652, where they may be advantageously automatically loaded into narrow elongated boxes or trays, known as "boats", and the loaded boats automatically transported to a platform or table from which they may be manually transported to shipping containers.

It will be understood that the foregoing general description and the following detailed description as well are exemplary and explanatory of the invention but are not restrictive thereof.

The accompanying drawings, referred to herein and constituting a part hereof, illustrate a preferred embodiment of the invention, and together with the description, serve to explain the principles of the invention.

DESCRIPTION OF THE PREFERRED EMBODIMENT

Figure 1:
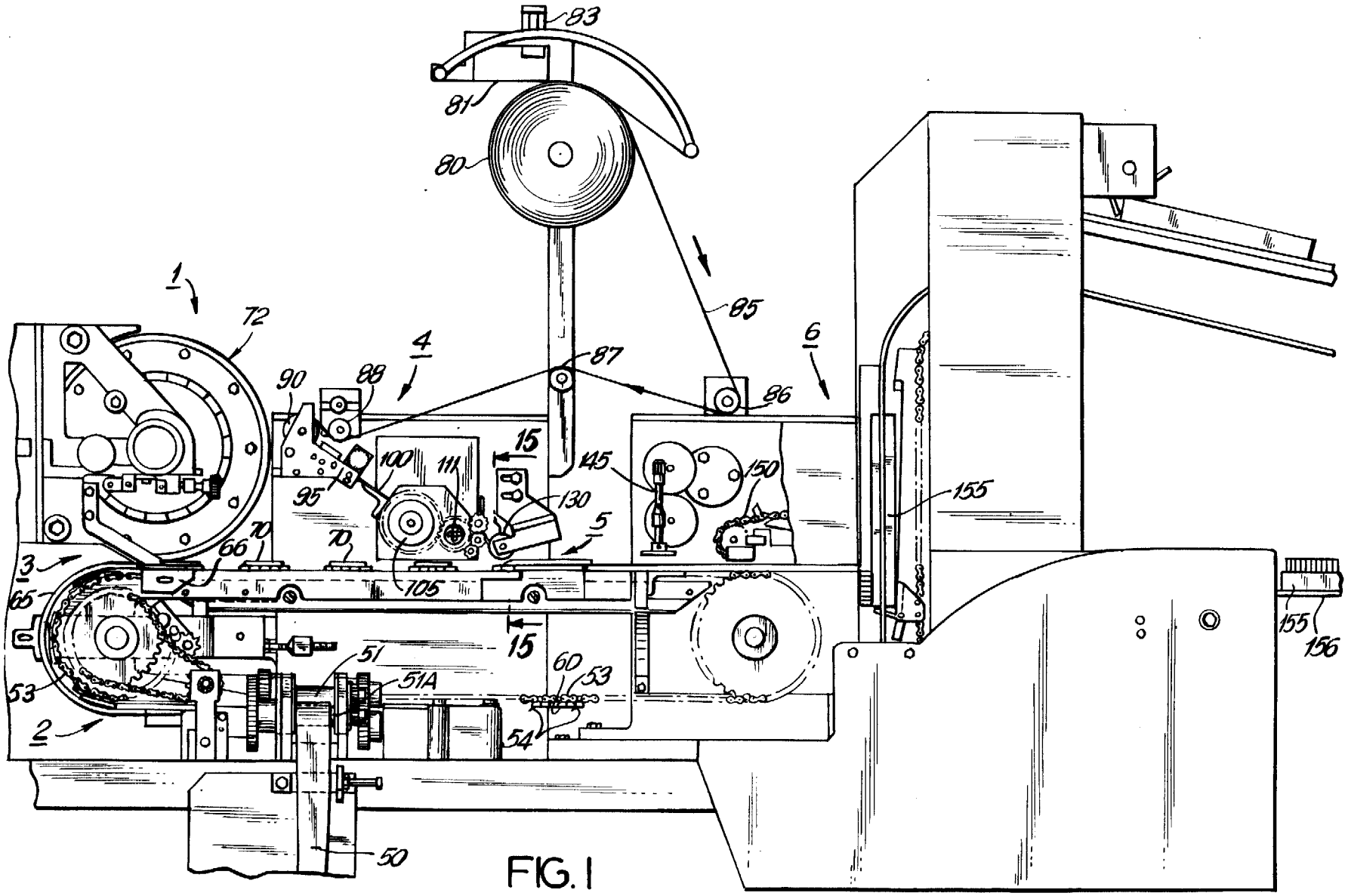
FIG. 1 is a side elevation of a packaging machine construction embodying the present invention.

Referring now more particularly to the preferred embodiment of the invention shown in the accompanying drawings, there is illustrated in FIG. 1 a packaging machine, designated generally by reference numeral 1, having a bottom channel fabrication section 2, a pat forming and depositing section 3, a cover channel fabrication section 4, a package assembly section 5, and a tray loading section 6.

A. Bottom Channel Fabrication Section

The bottom channel fabrication section 2 includes a suitable supply (not shown) of a relatively stiff paperboard, or other equivalent, material which is drawn from the supply in the form of a web 50 by driven rollers 51, 51A which feed the web of paperboard stock in conventional manner under a rotary cutting roller (not shown) where the paperboard is cut into individual cards 52 of predetermined length and thereafter accelerated by high speed driven rollers under a conveyor chain 53 moving in a direction perpendicular to the movement of web 50. Advantageously, the aforesaid cutting roller mechanism and high speed accelerating rollers for cutting the paperboard stock and feeding the individual cut cards into the path of the conveyor chain 53 are similar to that shown in FIG. 11, more fully described hereinafter.

Conveyor 53 grips and holds each individual card by a suitable clip member 54 (see FIG. 1A) mounted to each of the conveyor platforms 60 and advances the card through driven scoring rollers 55, 56 and from there to folder/unfolder unit 57.

Figure 15:
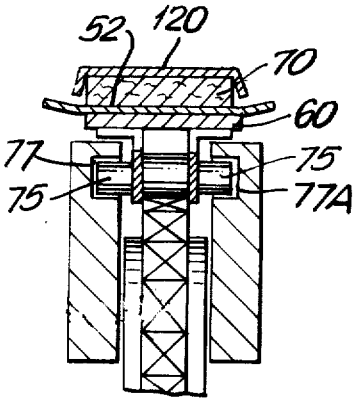
FIG. 15 is a fragmentary sectional view, partly in end elevation, taken along line 15—15 of FIG. 1, illustrating the conveyor chain and guide track of the bottom channel fabrication and package assembly sections.
Figure 16:
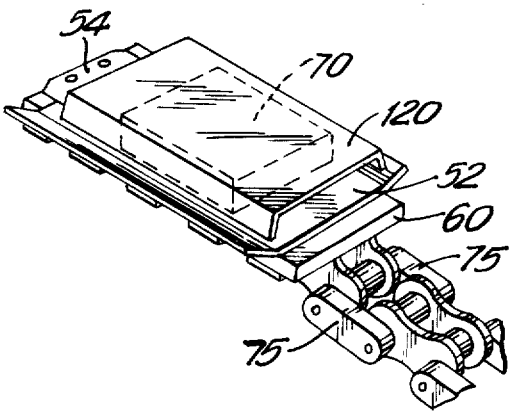
FIG. 16 is a fragmentary perspective view of the conveyor chain shown in FIG. 15.
Figure 17:
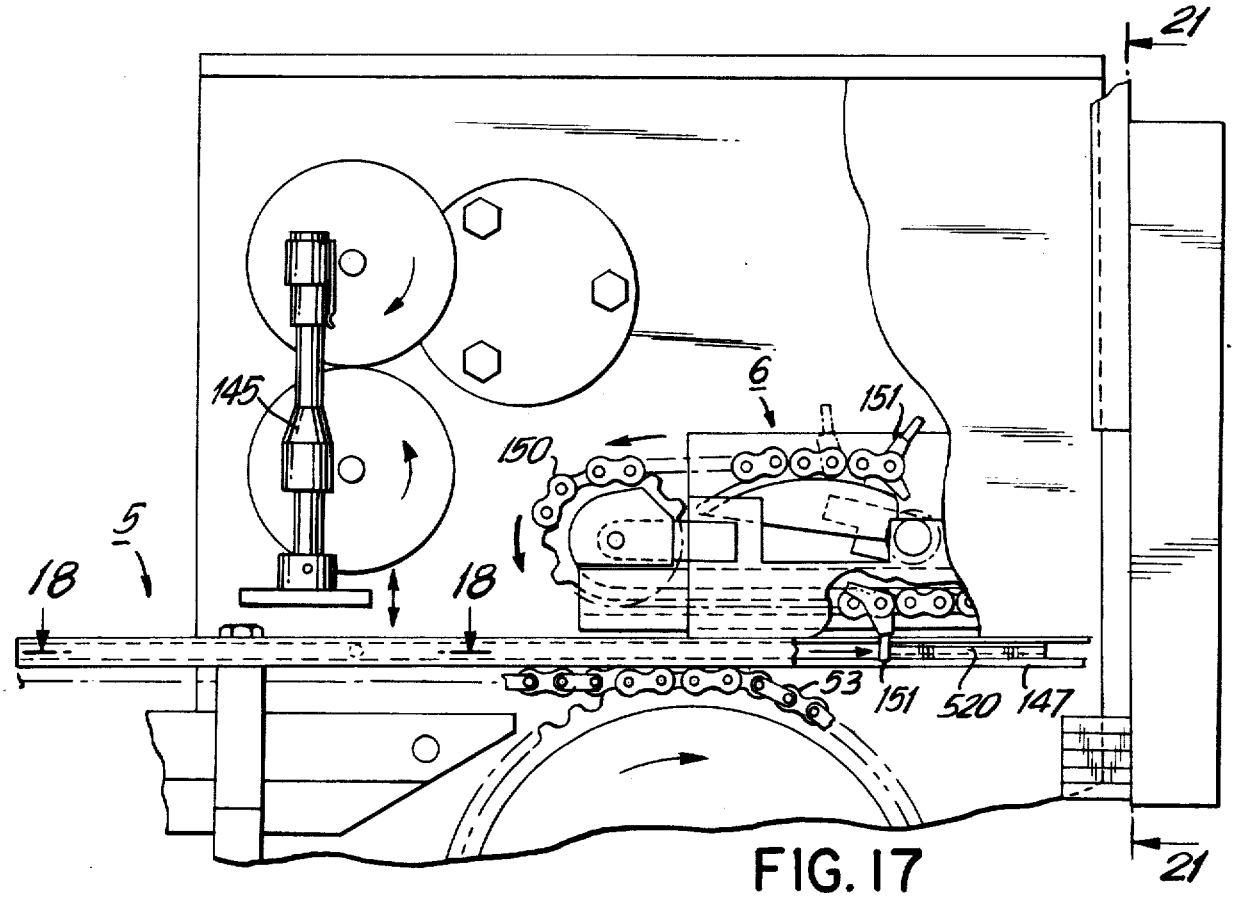
FIG. 17 is a fragmentary view in side elevation illustrating the tamper and tucking rail guide of the package assembly section and the upper accelerating conveyor chain assembly of the tray loading section of the machine shown in FIG. 1.

As best seen in FIGS. 15 and 16, because card 52 is bent into a narrow channel-shaped configuration in the completed package formed by machine 1, conveyor chain 53 and platforms 60 must be even slightly more narrow and it is therefore necessary to provide a guiding system to control the path of travel of the conveyor chain to a straight line with no erratic sidewise or up and down movement. To that end, as here embodied, the conveyor chain links 75 are joined by outer shoe links 76 having flat upper and lower surfaces which are slidably mounted in guide tracks 77, 77A.

Figure 4:
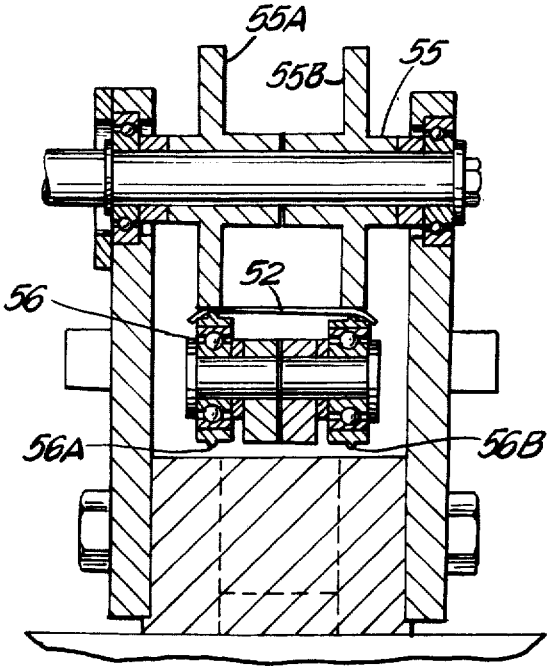
FIG. 4 is a fragmentary sectional view of the driven scoring rollers of the bottom channel fabrication section taken along line 4—4 of FIG. 2, illustrating the scoring of a bottom card cut from the bottom card stock supply.

As here preferably embodied, scoring roller 56 is provided with a pair of raised ribs 56A, 56B which rotate in closely spaced relationshio to anvil wheels 55A, 55B of driven roller 55. As best seen in FIG. 4, as conveyor chain 53 (not shown) passes between and through anvil wheels 55A, 55B, transporting card 52, card 52 is compressed between ribs 56A, 56B and anvils 55A, 55B, forming a pair of opposed parallel score lines 52A, 52B adjacent two parallel edges of card 52.

It will be seen that by providing driven anvil roller 55 compressing card 52 against scoring roller 56, thus positively gripping and driving card 52 therebetween transported by conveyor chain 53, cards 52 are scored accurately and consistently, ensuring the later formation of the card into a channel which is in true alignment throughout its length. Also, as shown in FIG. 4, ribs 56A, 56B are rounded, or may be otherwise suitably blunted, so as to compress, rather than pierce or cut, the paperboard material of the card. It has been found that forming the score in this manner is highly advantageous in preventing moisture or oil contained in the enclosed product from being absorbed into the paperboard.

Figure 2:
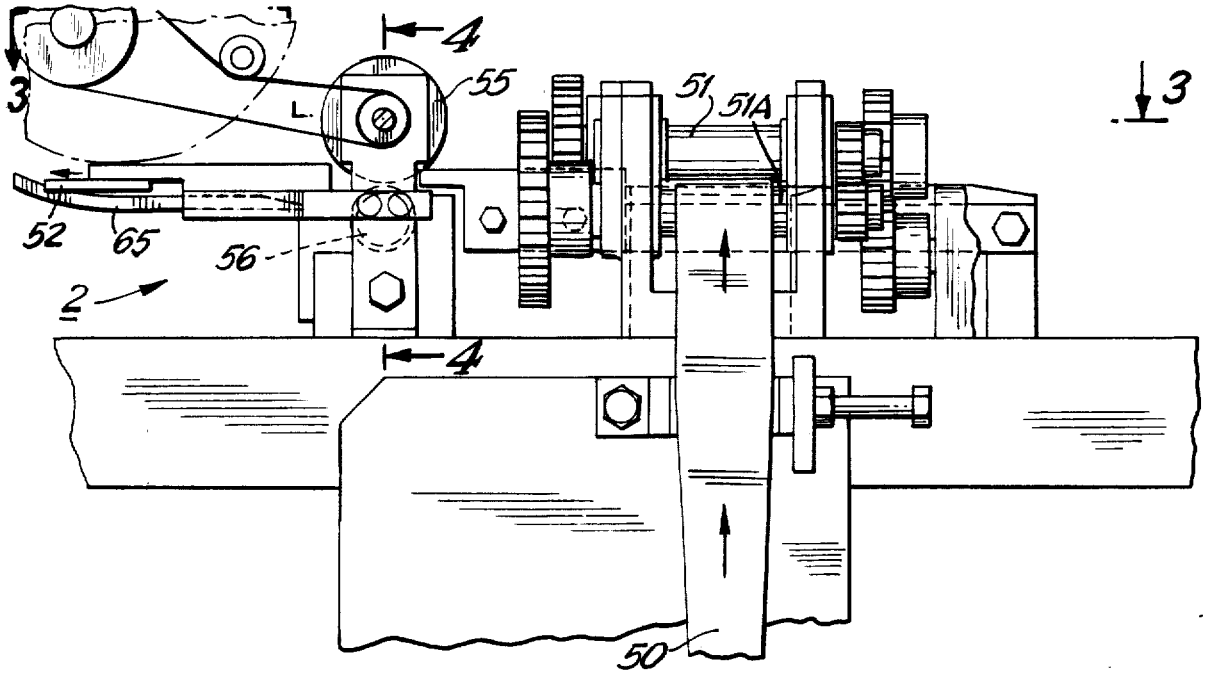
FIG. 2. is a fragmentary view in side elevation of the bottom card feed mechanism and driven scoring rollers cf the FIG. 3 is a fragmentary top plan view, partly in section, of the bottom card feed and scoring roller mechanism, taken along line 3—3 of FIG. 2.
Figure 3:
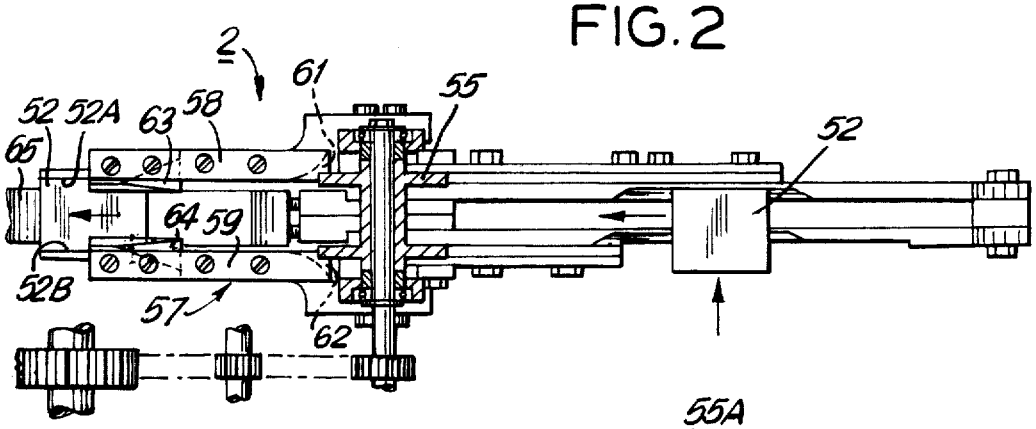

As best seen in FIGS. 2 and 3, folder/unfolder unit 57 comprises a pair of opposed rail members 58, 59 provided with inwardly and downwardly inclined side walls 61, 62 which engage the scored edges of card 52 and bend them gradually downwardly to form card 52 into a channel-like shape with opposed channel sides 52C, 52D. Advantageously, side walls 61, 62 are inclined so as to put a radical bend on the scored edges of card 52, preferably well beyond 90°, in order to also ensure that card 52 may be later formed into a true channel and fitted closely about the product to be enclosed, as more fully described hereafter.

As embodied, folder/unfolder unit 57 also includes a second set of upwardly and outwardly inclined side walls 63, 64 which immediately engage and partially re-open the channel sides 52C, 52D of card 52. Alternatively, it has been found that a paperboard material of the thickness desired for card 52 has sufficient stiffness and resiliency to spring back naturally into a partially re-opened position after bending and consequently, that side walls 63, 64 may be optionally omitted with satisfactory results.

Figure 1A:
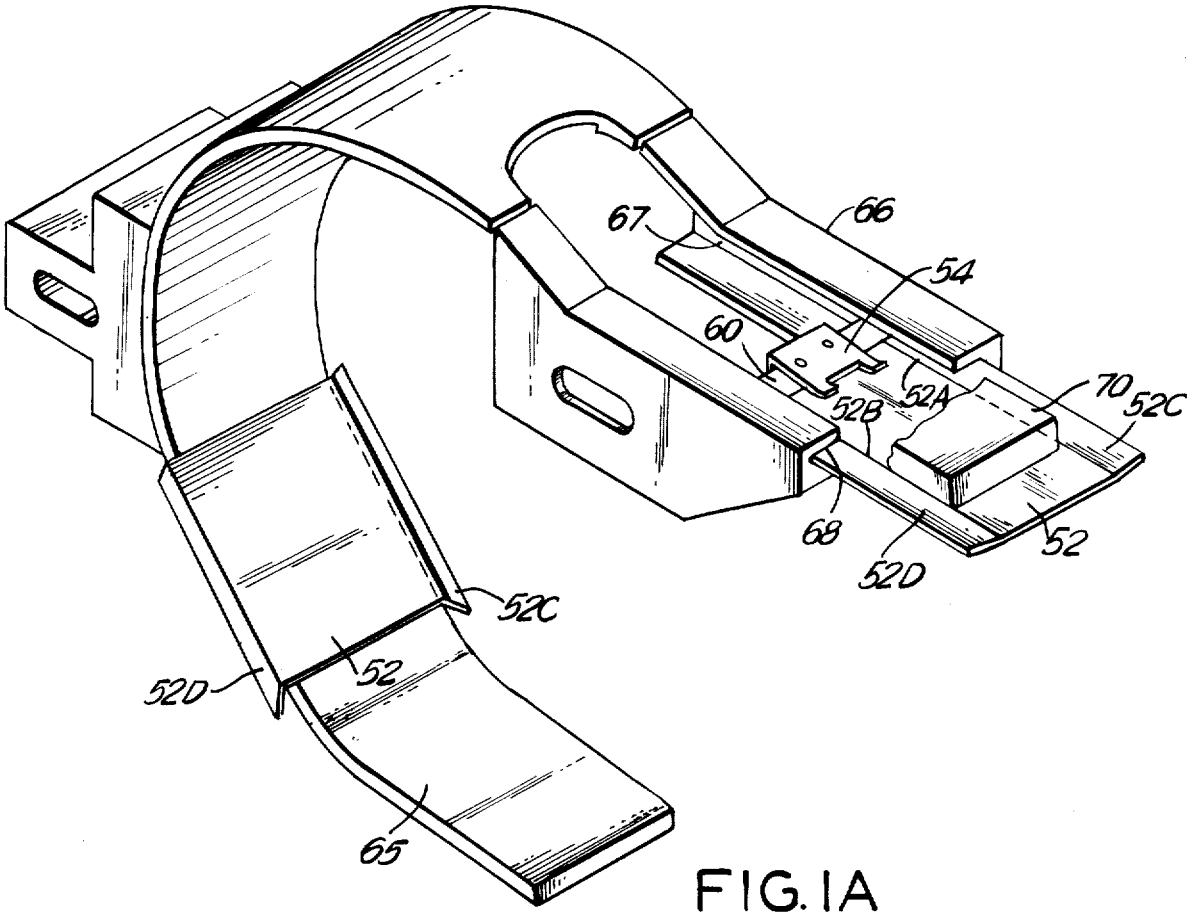
FIG. 1A is an enlarged view in perspective of the bottom card unfolding mechanism of the present invention in which the pre-bent channel-shaped card is reopened and substantially flattened.
Figure 1B:
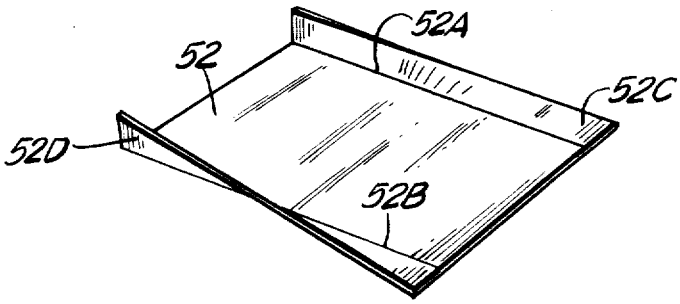
FIG. 1B is an enlarged perspective view of an individual bottom card illustrating the card in its partially pre-bent channel shape and partially reopened and substantially flattened.

After passing through folder/unfolder unit 57, conveyor 53 carries the pre-scored, pre-bent and partially unfolded card 52 onto a generally semi-circularly shaped guide member 65 mounted circumferentially about the end sprocket gear driving conveyor 53. As best seen in FIGS. 1A and 1B, guide 65 gradually widens to further gradually re-open the previously formed channel sides of card 52 and finally delivers the card into a forming block 66 having opposed guide slots 67, 68 which spread channel sides 52C, 52D of card 52 into a substantially flattened position.

It will be understood from the foregoing that upon passing through forming block 66, the pre-bent and substantially flattened card 52 is ready to receive an individual service portion of a product thereon. Although the present invention is not limited to any particular shape or product material, it is particularly advantageously useful for packaging generally rectangularly-shaped pats of butter or margarine or like product. To that end, for ease of description only, the package formed by the machine and method of the present invention is hereinafter described with reference to a rectangular butter pat but it will be understood the invention is not limited to such usage.

Accordingly, while scored card 52 is being held flat by forming block 66, a rectangularly-shaped pat of butter 70 is advantageously formed and deposited onto the approximate center of card 52 by a suitable forming and feeding drum 72 as is more fully described and illustrated in the aforesaid Redmond U.S. Pat. No. 3,129,546.

Advantageously, and as here preferably embodied, butter pat 70 is shaped and sized so that two opposed sides thereof are aligned with and in close overlying relationship to the score lines 52A, 52B formed in card 52. Card 52 is longer than pat 70 to provide end margins adjacent the sides of pat 70 perpendicular to the sides aligned with the score lines. It will be seen that the provision of end margins serves to both create a neat, elongated appearance to the package and provide a surface for gripping when it is desired to open the package and use the contents thereof.

Finally, it will be understood from the foregoing that the provision of means for scoring, bending and reopening card 52 into a substantially flattened configuration enables a rectangular pat of butter to be deposited onto card 52 without the numerous difficulties of precise placement that would be required if card 52 was in its channel configuration and yet fit snugly and cleanly within the channel walls when later erected.

After the butter pat 70 is deposited onto the pre-scored card 52, conveyor 53 continues to transport the pat-carrying, pre-scored card 52 toward package.assembly section 4.

B. Cover Channel Fabrication Section

The cover channel fabrication section 4 includes a suitable stock supply 80 of a relatively thin and flexible top cover material 85, preferably paper or a "deadfold" foil, or other equivalent material. Advantageously, conventional roll stock brake means 81 engages roll 80 to control unwinding of material 85 and a suitable switch 83 may be provided to detect when roll 80 is used up and stop the machine for reloading.

Material 85 is continuously drawn from supply roll 80 over a series of flanged idler guide rollers 86, 87, 88 which direct the web of material 85 through a pair of opposed scoring rollers 90, 91 which form a pair of parallel score lines 85A, 85B in material 85 spaced apart a distance approximately equal to score lines 52A, 52B in bottom card 52.

Figures 5, 5A:
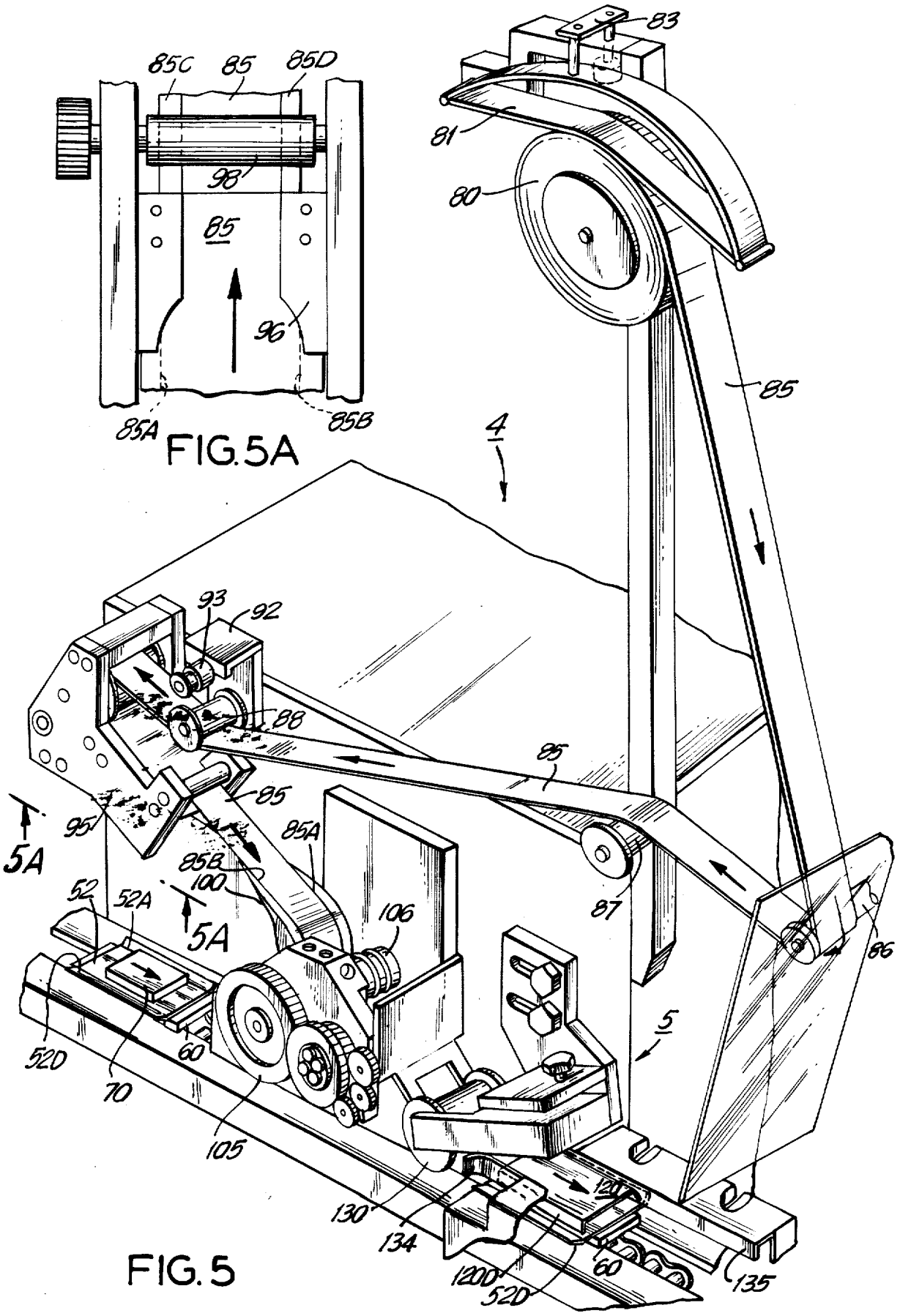
FIG. 5 is an enlarged fragmentary perspective view showing the cover channel fabrication section and a portion of the package assembly section of the packaging machine shown in FIG. 1.
FIG. 5A is a fragmentary bottom plan view taken along line 5A—5A of FIG. 5, illustrating the entrance of the top cover material web to the scoring rollers of the cover channel fabrication section.
Figure 6:
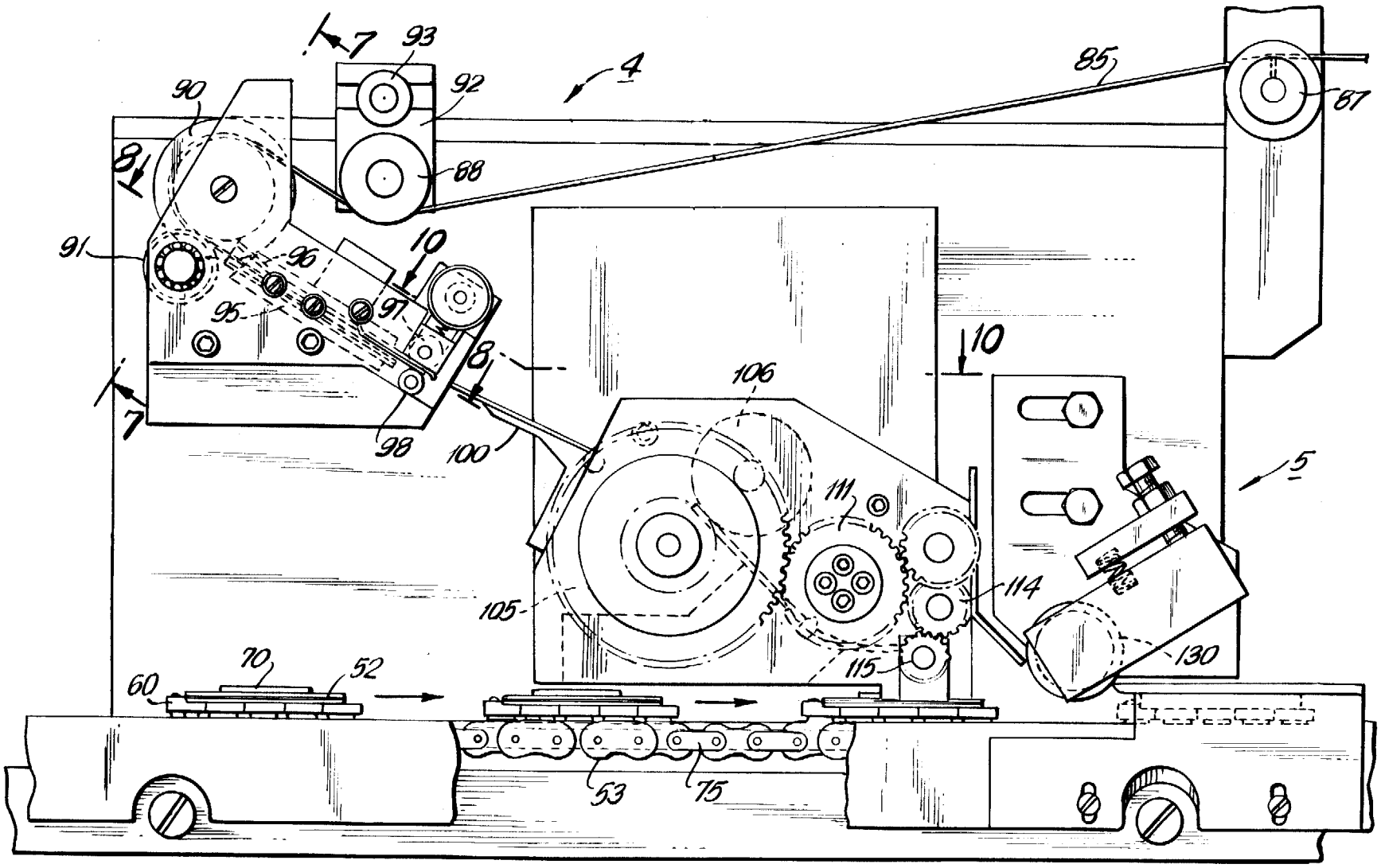
FIG. 6 is a fragmentary view in side elevation illustrating the cover channel fabrication section and a portion of the package assembly section shown in FIG. 5.
Figure 7:
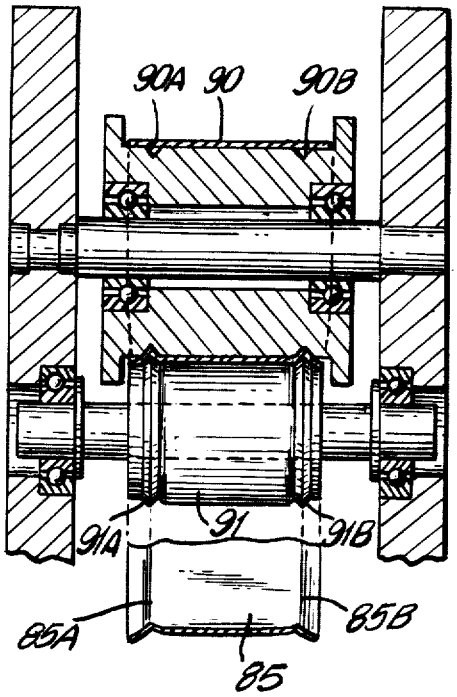
FIG. 7 is a fragmentary sectional view taken along line 7—7 of FIG. 6, illustrating the scoring rollers for the cover channel fabrication section.
Figure 8:
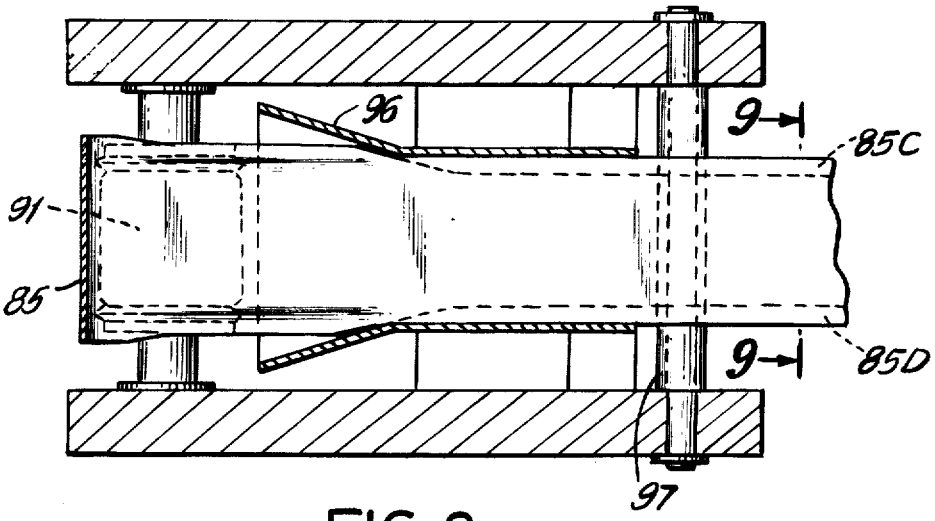
FIG. 8 is a fragmentary top plan view taken along line 8—8 of FIG. 6, showing the folding and creasing unit of the cover channel fabrication section which folds the scored edges of the cover material under the moving material web and compresses the folded edges flat onto the web.
Figure 9:
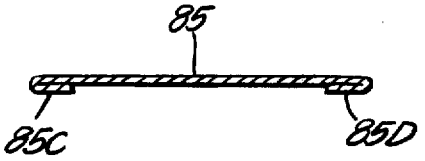
FIG. 9 is a sectional view taken along line 9—9 of FIG. 8, illustrating the scored edges of the cover material folded under and compressed flat onto the material web.
Figure 10:
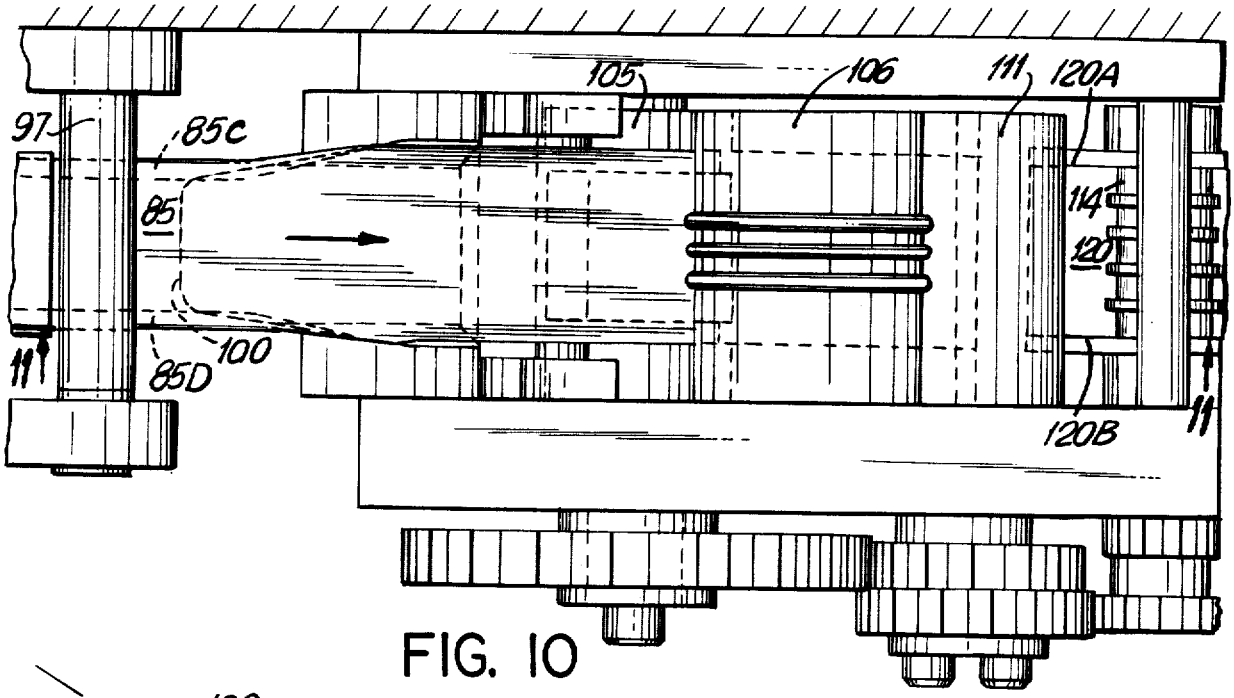
FIG. 10 is a fragmentary top plan view, partly sectional, taken along line 10—10 of FIG. 6, showing draw rollers which draw the web of cover material from the stock supply, the cutting and cover sheet guide unit, and the accelerating rollers which grip and accelerate the cut and pre-creased cover sheet into the package assembly section.
Figure 22:
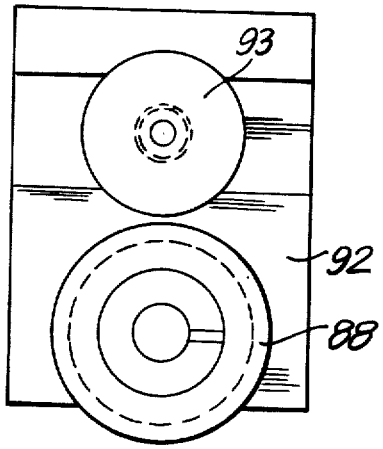
FIG. 22 is an enlarged fragmentary view in end elevation of the cover material web guide roller unit shown in FIG. 1.
Figure 23:
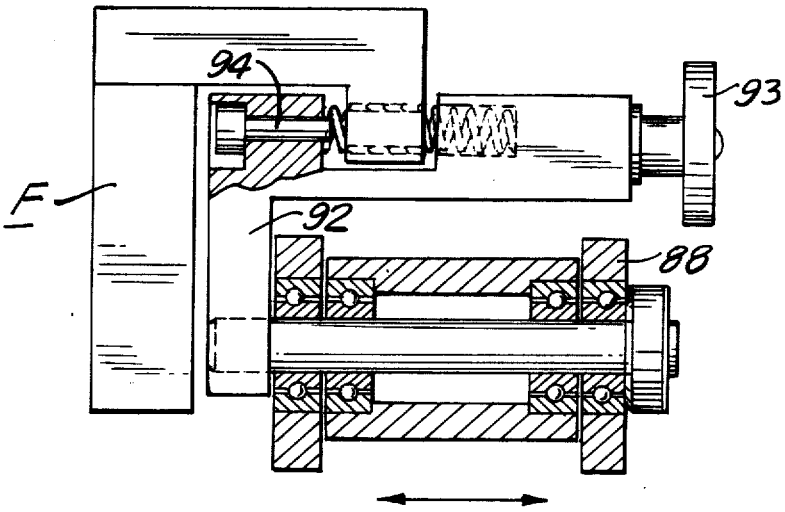
FIG. 23 is a partly sectional, partly elevational view of the web guide unit shown in FIG. 22, the view illustrating the adjustment mechanism for adjusting the lateral position of the flanged web guide roller.

In accordance with the invention, means are provided for guiding material web 85 in accurate alignment through scoring rollers 90, 91. To that end, as here preferably embodied, and as best seen in FIGS. 5 and 22–23, flanged guide roller 88 is rotatably mounted in bracket 92 which in turn is mounted for adjustable movement transversely of web 85 by a threaded knob 93 which forces pin 94 toward or away from the machine frame F.

Scoring rollers 90, 91 are preferably suitably provided with opposed circumferentially extending ridges 90A, 90B in mating relationship to circumferentially extending grooves 91A, 91B, respectively. It will be seen from the foregoing that the provision.of aligned and mating ridges and grooves in scoring rollers 90, 91 results in the formation of very accurate, consistent, and true score lines in material web 85.

The scored material web 85 is thereafter drawn through a creasing unit 95 including a funnel-shaped former 96 which engages the opposed scored edges 85C, 85D of web 85 and folds them under and back onto web 85 whereupon edges 85C, 85D are compressed flat onto web 85 by opposed pressure adjustable rollers 97, 98. After folding and flattening of edges 85C, 85D, these edges are then passed over a wedge-shaped forming member 100 which again reopens and substantially flattens out edges 85C, 85D into a single plane with web 85, whereupon the pre-creased and substantially flat web 85 passes between the opposed driven draw rollers 105, 106 which grip and pull web 85 from the stock supply 80.

Figure 11:
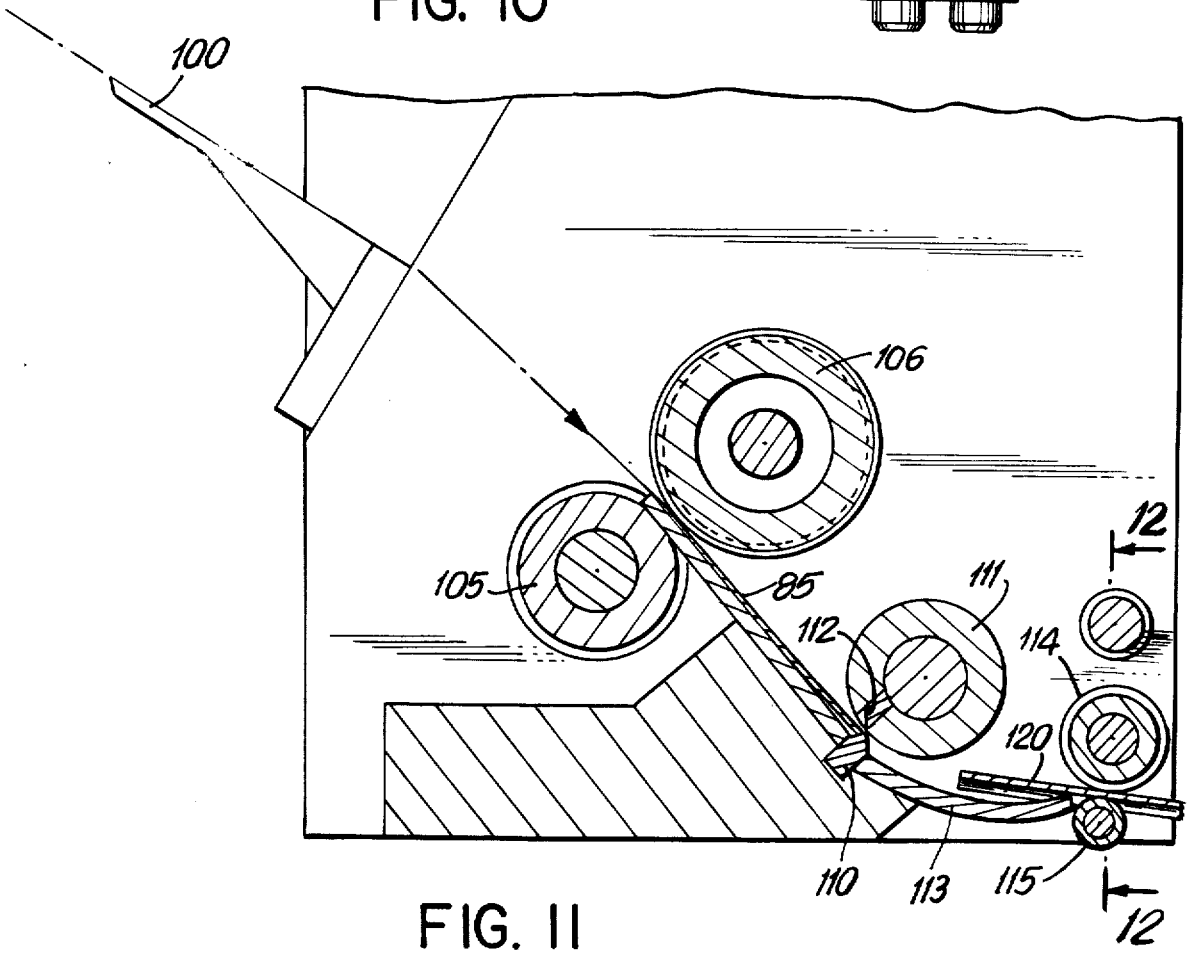
FIG. 11 is a fragmentary sectional view, partly in side elevation, taken along line 11—11 of FIG. 10.
Figure 12:
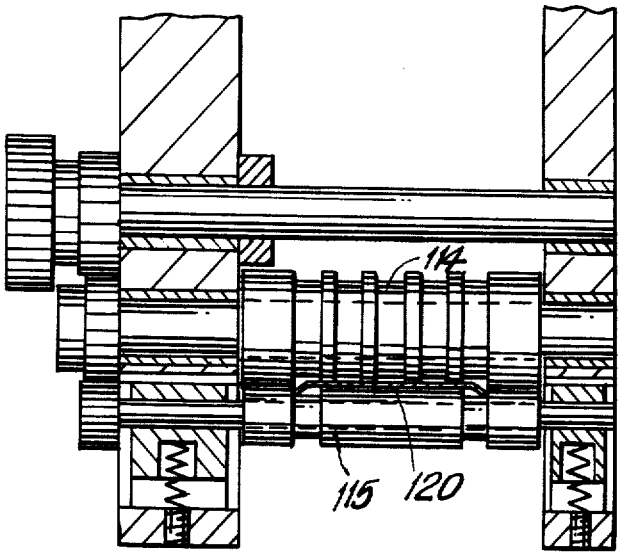
FIG. 12 is a fragmentary view in end elevation, partly in section, taken along line 12—12 of FIG. 11, illustrating an individual pre-creased cover sheet gripped between the high speed driven accelerating rollers of the cover channel fabrication section.

Draw rollers 105, 106 thereafter drive the pre-creased web of cover material 85 through cutting means, which comprise a lower stationary knife blade 110 and an upper driven rotating cutting knife 112 held in adjustably mounted cylinder 111 on its circumferential surface, and web 85 is thereafter directed by guides 113 into engagement with driven high speed accelerating rollers 114, 115. As best shown in FIG. 11, the position and timing of cutting knife 112 is set so that the leading end of web 85 is received between and initially slidingly held by accelerating rollers 114, 115 just prior to the time that blade 112 rotates into cutting position against stationary blade 110. Rotation of blade 112 into contact with blade 110 cuts web 85 into individual pre-creased sheets 120 of predetermined length, preferably approximately equal to the length of bottom card 52, whereupon the cut sheet is instantaneously accelerated forward into the package assembly section 5, where it is deposited onto butter pat 70.

Advantageously, and as will be understood from the foregoing, the relative timing and speed of cutting knife 112 and accelerating rollers 114, 115 are selected so that the individual pre-creased sheets 120 of the top cover material are cut to the desired length and then accelerated forward to a speed coinciding with the speed of travel of the conveyor chain 53 transporting the pre-bent bottom card 52 carrying butter pat 70. Also, as preferably embodied, the aforesaid accelerating movement is of such speed and timing to create a space between successively cut individual top cover sheets 120 which is identical to the space between the transverse center lines of two succeeding bottom cards carried by the conveyor chain 53, to thereby deposit the pre-creased top sheet 120 onto the center of the butter pat 70 carried by the bottom card.

C. Package Assembly Section

Figure 13:
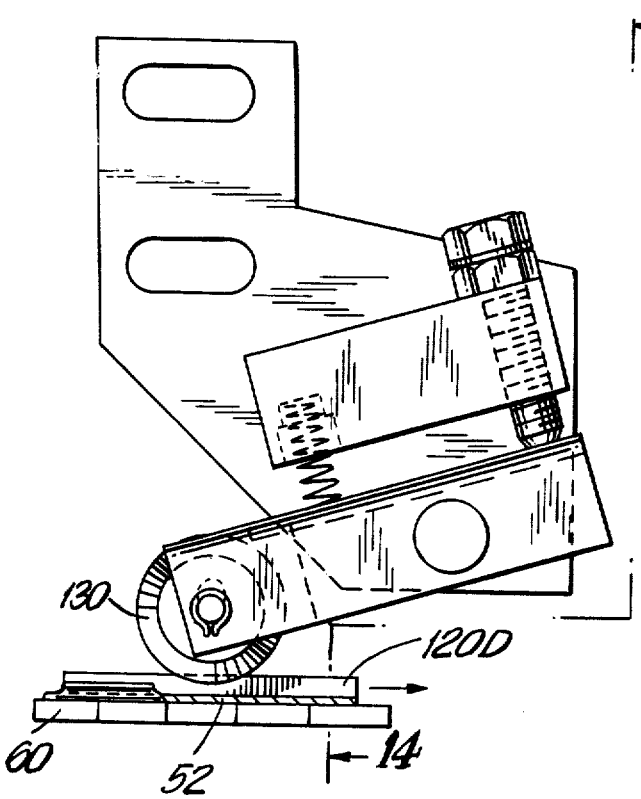
FIG. 13 is an enlarged fragmentary side elevational view of the rolling and tucking spool roller of the package assembly section of the machine shown in FIG. 1.
Figure 14:
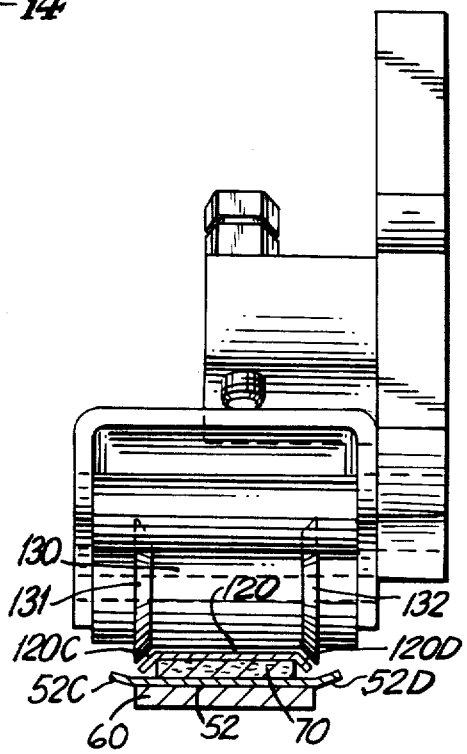
FIG. 14 is a fragmentary view in end elevation taken along line 14—14 of FIG. 13, illustrating the spool roller rolling the cover sheet into adhering contact with the top of the product pat carried by the bottom card and bending the scored edges of the cover sheet downwardly closely adjacent to the sides of the pat.

The package assembly section 5 includes a spring-loaded flanged rolling and tucking spool roller 130 mounted directly above and in alignment with the top of the butter pat 70 being transported beneath roller 130 by conveyor 53. As best seen in FIGS. 13 and 14, the pre-creased cover sheet 120 properly positioned relative to butter pat 70 passes under roller 130, whereupon sheet 120 is rolled into adhering contact with the top surface of butter pat 70 and, simultaneously, the spool flanges 131, 132 of roller 130 bend the pre-creased edges of cover sheet 120 downwardly and closely adjacent to or in partial contact with two opposed sides of butter pat 70, thereby forming cover sheet 120 into a channel-shaped configuration having channel side walls 120C, 120D.

Advantageously, and as here preferably embodied, conveyor 53 thereafter transports card 52 between opposed longitudinally extending side pressure rails 134, 135, preferably shaped similar to the bottom of a ski, which thereafter guide and compress the aforesaid channel sides 120C, 120D of covered sheet 120 against and in generally adhering contact with the sides of butter pat 70.

After the channel-shaped cover sheet 120 is adhered to the top and two opposed sides of butter pat 70, conveyor 53 passes through a pair of opposed longitudinally-extending plow members 138, 139 which raise the pre-scored and pre-bent side edges 52C, 52D of the bottom card 52 into a generally upright position to thereby form channel sides which preferably are in substantially adhering contact, or close-fitting relationship, with the sides of butter pat 70 and also are in overlapping contacting relationship with the outer surfaces of the downwardly extending channel sides 120C, 120D of the top cover sheet 120.

Figure 18:
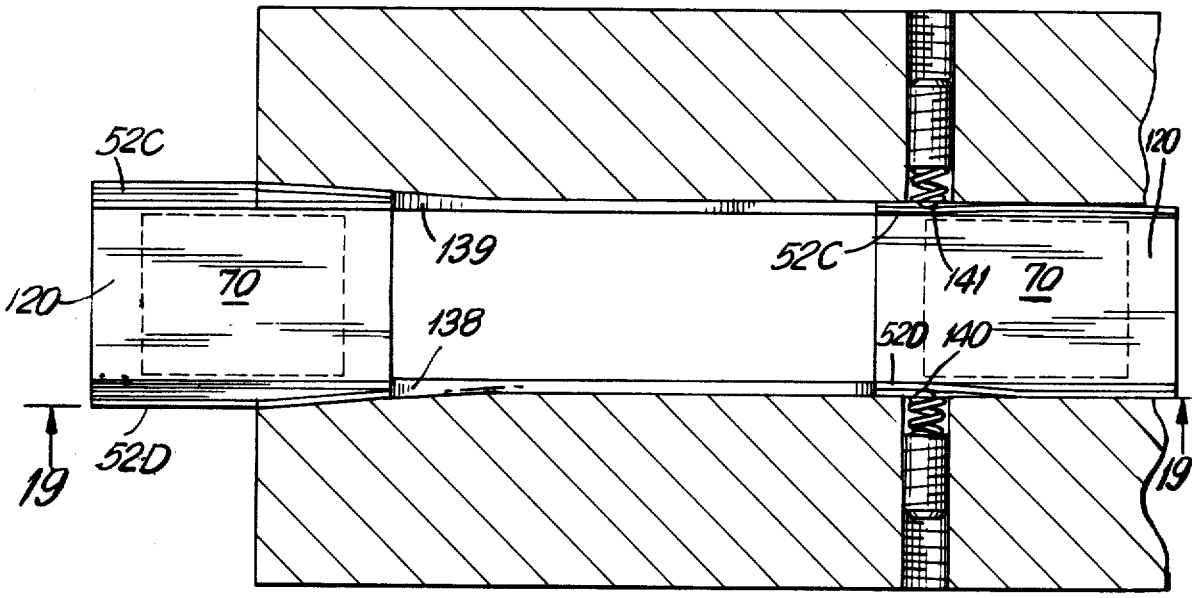
FIG. 18 is a fragmentary top plan view taken along line 18—18 of FIG. 17, illustrating opposed inclined plow rails raising the pre-bent sides of the bottom card into a vertical position, thereby forming the bottom card into a channel-shaped configuration, and opposed spring-loaded ball detents pressing the bottom channel sides into adhering contact with the sides of the product and into overlapping contact with the channel sides of the cover channel member adhered to the product.
Figure 19:
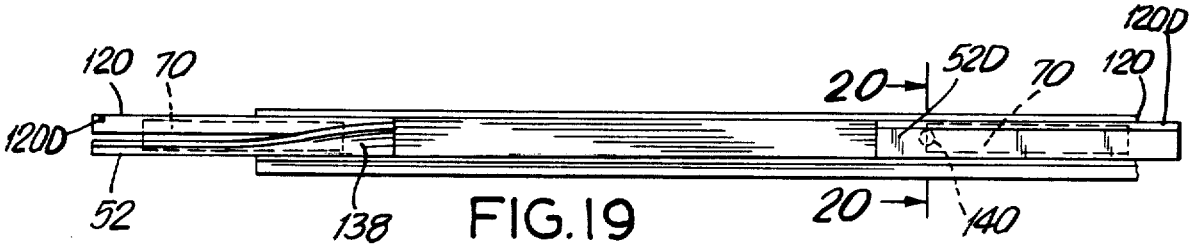
FIG. 19 is a fragmentary view in side elevation taken along line 19—19 of FIG. 18.
Figure 20:
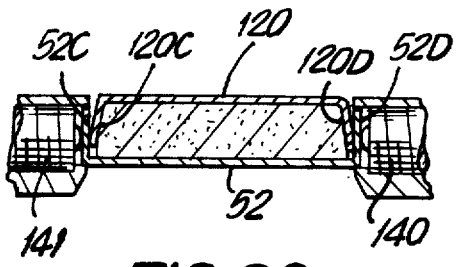
FIG. 20 is a fragmentary sectional view taken along line 20—20 of FIG. 19, illustrating the completed package produced by the machine shown in FIG. 1.
Figure 21:
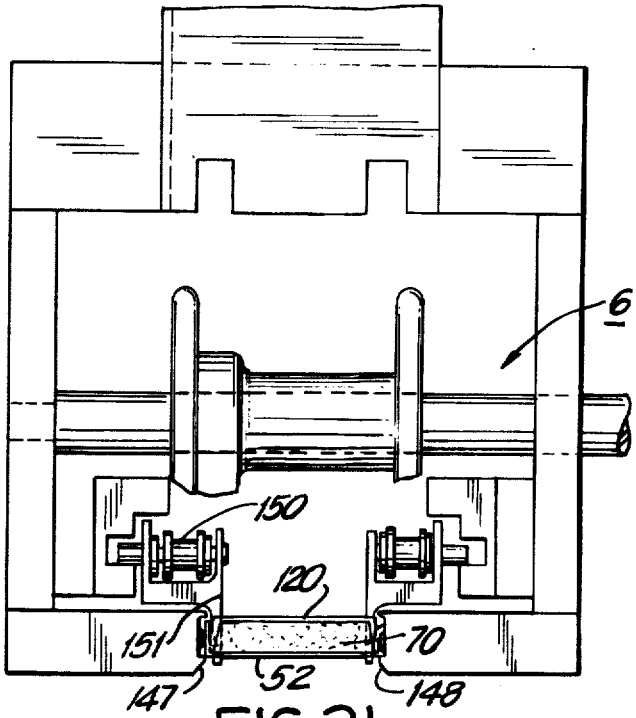
FIG. 21 is a fragmentary view in end elevation taken along line 21—21 of FIG. 17, illustrating an extended finger of the upper conveyor chain assembly of the tray loading section engaging and accelerating a completed package away from the package assembly section and into the tray loading section.

Advantageously, as best seen in FIGS. 18–20, opposed adjustable rail guide means containing spring-loaded detents 140, 141 thereafter press the bottom card channel sides 52C, 52D into generally adhering contact with the lower portion of the sides of the butter pat 70 and into close-fitting overlapping contact with the outer surfaces of the top cover channel sides 120C, 120D.

Finally, as here preferably embodied, immediately following erection of the bottom channel sides 52C, 52D into adhering and overlapping contact with the sides of butter pat 70 and the outer surfaces of cover channel sides 120C, 120D, tamper 145 finally sizes and shapes the completed package. Advantageously, tamper 145 may be constructed as shown and described in the aforesaid Redmond U.S. Pat. No. 4,449,350.

The completed packages in accordance with the invention are thereafter transported and deposited by conveyor 53 onto spaced side rails 147, 148, where they are pushed forward by an overhead conveyor chain assembly 150 having rotatably mounted finger members 151 which engage and accelerate the completed packages away from the package assembly section 4 and into the tray loading section 5.

D. Tray Loading Section

Although not forming a part of the present invention, the completed packages preferably are thereafter suitably transported by conveyor 150 to a tray loading station 5, e.g., as shown and described in my aforesaid U.S. Pat. No. 3,631,652, where they may be advantageously automatically loaded into narrow elongated boxes or trays 155, known as "boats", and the loaded boats automatically transported to a platform or table 156 from which they may be manually placed into shipping containers.

It will be seen from the foregoing general and detailed descriptions that the objects of the invention specifically enumerated herein are accomplished by the invention as here embodied.

Thus, the method and apparatus of the present invention are capable of manufacturing rigid unitized packages enclosing and adhered on four sides to an individual service portion of butter, margarine or similar product at speeds of on the order of 1,500–1,800 packages per minute, and yet the finished packages are of improved quality in appearance and consistency of production. Also, the method and apparatus of the present invention, by pre-scoring and pre-bending each of the top and bottom channel members forming the package enclosure, produce a finished package having unusually sharply defined corners which give an improved crispness and neatness to the appearance of the package. Pre-scoring and pre-bending of the package components also permits a package to be produced which substantially completely encases the product and yet does not require the use of any external adhesive, thereby further enhancing the speed, efficiency and economy of production of the packages, while reducing materials costs by nearly one-third.

The invention in its broader aspects is not limited to the specific embodiments herein shown and described but departures may be made therefrom within the scope of the accompanying claims, without departing from the principles of the invention and without sacrificing its chief advantages.

What is claimed is:

1. A method for high speed continuous and uninterrupted production of rigid unitized packages for storing, shipping and handling an individual service portion of a spreadable product and for supporting said spreadable product for use after opening said packages, comprising the steps of:

(a) cutting a continuous supply of relative stiff material into individual substantially flat base cards of predetermined length;

(b) forming parallel score lines adjacent two opposed edges of each of said base cards;

(c) bending the scored edges of said base cards approximately perpendicular to the intermediate portion thereof to form a channel-shape configuration;

(d) reopening the channel sides of said base and reforming said base card to a substantially flat configuration;

(e) depositing an individual service portion of a spreadable product onto the substantially flattened, pre-scored base card between said score lines;

(f) forming a continuously moving web of relatively thin flexible material;

(g) forming parallel score lines adjacent the opposed edges in said web thereof spaced apart a distance approximately equal to the score lines in said base cards;

(h) folding the scored web edges onto said web and pressing the folded edges flat;

(i) reopening the folded web edges and returning the web to a substantially flat configuration;

(j) continuously cutting the pre-creased web into successive individual pre-creased sheets of predetermined length;

(k) substantially instantaneously after cutting, accelerating said individual pre-creased sheets away from the cut web and depositing said pre-creased sheets onto successive individual service portions of a spreadable product carried by said base cards;

(l) rolling and bending said pre-creased sheet into adhering contact with the top and two opposed sides of said spreadable product, said pre-creased sheet thereby forming a channel-shaped cover member about the top of said spreadable product; and (m) bending the channel sides of said pre-bent base upwardly into adhering contact with said spreadable product and overlapping contact with the outer surfaces of the top cover channel sides, said pre-scored base thereby forming a channel-shaped cover member about the bottom of said spreadable product.

2. A method as claimed in claim 1, wherein said top cover and base card members are longer than said individual service portion of a spreadable product so as to form end margins between the channel sides of the top and bottom cover members.

3. A method as claimed in claim 1, wherein said spreadable product is a tacky substance and said individual service portion is generally flat and rectangularly-shaped having a width approximately equal to the distance between said score lines in said base card.

4. A method as claimed in claim 1, including the steps of:

pressing the channel sides of said cover channel member into adhering contact with the sides of said spreadable product; and pressing the channel sides of said bottom channel member into adhering contact with said spreadable product and into close fitting overlapping contact with the outer channel side surfaces of said cover channel member.

5. Apparatus for high speed production, with continuous, uninterrupted and synchronous movement, of rigid unitized packages for storing, shipping and handling an individual service portion of a spreadable product and for supporting said spreadable product for use after opening said packages, including:

(a) a continuous supply of a relatively stiff, substantially flat material;

(b) means continuously cutting said relatively stiff material into individual substantially flat base cards of predetermined length;

(c) driven scoring roller means forming parallel score lines in said base cards adjacent two parallel edges thereof;

(d) folding means bending the scored edges of said base cards approximately perpendicular to the intermediate portion thereof to form a channel-shaped configuration;

(e) unfolding means reopening and substantially flattening said base cards;

(f) means forming and continuously depositing an individual service portion of a spreadable product onto each successive substantially flattened, pre-scored base card between said score lines;

(g) a continuous supply of a relatively thin, flexible material;

(h) driven roller means drawing a continuously moving web of said relatively thin material from said supply;

(i) roller guide means maintaining said web in desired alignment;

(j) scoring roller means forming parallel score lines in said web adjacent the opposed edges thereof, said score lines spaced apart a distance approximately equal to that between the base card score lines;

(k) folding and creasing means folding the scored web edges onto said web and pressing the folded edges flat;

(1) unfolding means reopening said folded web edges and substantially flattening said web;

(m) said driven roller means driving the leading end of the pre-creased web through cutting means and into sliding gripping engagement by opposed high speed accelerating roller means, said cutting means cutting said web instantaneously following said web being engaged by said accelerating rollers;

(n) said accelerating rollers accelerating individual pre-creased sheets of predetermined length cut from said web and locating said sheets above successive individual service portions of a spreadable product carried by said base cards and below flanged roller means;

(o) means adjustably mounting said flanged roller means directly above and in alignment with said spreadable product, said flanged roller means adapted to essentially simultaneously roll and bend said pre-creased sheet into adhering contact with the top and two sides of said spreadable product to thereby form said pre-creased sheet into a channel-shaped cover member about the top and sides of said spreadable product; and (p) means bending the channel sides of said pre-scored base card upwardly into adhering contact with said spreadable product and overlapping contact with the outer surfaces of the cover channel sides, said pre-scored base thereby forming a channel-shaped cover member about the bottom of said spreadable product.

6. Apparatus as claimed in claim 5, wherein said scoring means forming said scoring lines in said base card comprises:

driven roller means provided with anvil wheels;

a scoring roller having a pair of circumferentially extending parallel rib members mounted adjacent said anvil wheels; and means transporting said base card between said rib members and said anvil wheels;

whereby said rib members on said scoring roller compress two parallel score lines in said base card.

7. Apparatus as claimed in claim 5, wherein said folding means comprises:

a pair of rail members having opposed inwardly and downwardly extending side walls adapted to engage the scored edges of said base cards; and means transporting said pre-scored base cards between said rail members, whereby said side walls of said rail members bend the scored edges of said base cards approximately perpendicular to the intermediate portion thereof to thereby form said base card into a channel member.

8. Apparatus as claimed in claim 5, wherein said unfolding means comprises:

guide means having a narrow front end adapted to fit snugly within the channel formed in said base card by said folding means and a widened and outwardly beveled rear end; and means transporting said channel-shaped base card in sliding contact with said unfolding guide means to thereby open and substantially flatten the channel sides of said base card as said card passes over said rear end of said guide means.

9. Apparatus as claimed in claim 5, wherein said unfolding means for said base cards includes:

means adapted to hold the pre-bent channel sides of said base card in an open and substantially flattened position as said individual service portion of a spreadable product is being deposited onto said base card.

10. Apparatus as claimed in claim 5, wherein said web roller guide means comprises:

a flanged roller having opposed flanges mounted closely adjacent to the edges of the traveling web; and means adjustably mounting said flanged roller transversely of the path of travel of said web, whereby adjustment of said roller guide correspondingly adjusts the path of travel of said web.

11. Apparatus as claimed in claim 5, wherein said scoring roller means forming parallel score lines in said web comprises opposed scoring rollers, one of said scoring rollers having a pair of circumferentially extending parallel ridges in mating relationship with a pair of circumferentially extending parallel grooves formed in the other of said scoring rollers.

12. Apparatus as claimed in claim 5, wherein said folding and creasing means comprises:

a funnel-shaped member having inwardly and downwardly curved side walls adapted to engage the scored web edges and fold them under and back onto the traveling web; and opposed spring-loaded rollers compressing the folded web edges flat against the traveling web.

13. Apparatus as claimed in claim 5, wherein said web unfolding means comprises:

wedge means having a narrow front end adapted to fit between the folded edges of said web and a widened and outwardly inclined rear end.

14. Apparatus as claimed in claim 5, wherein the web cutting means comprises:

a stationary knife blade;

a rotatably adjustably mounted cylinder member; and a knife blade mounted on the circumferential surface of said cylinder;

whereby said web is cut as said knife blade mounted to said cylinder rotates into contact with said stationary knife blade.

15. Apparatus as claimed in claim 5, including:

a pair of opposed resilient side rail members adapted to engage and compress the sides of said cover channel into adhering contact with the sides of said spreadable product.

16. Apparatus as claimed in claim 5, including:

opposed spring-loaded detent means adapted to engage and compress the channel sides of said bottom channel against the sides of said spreadable product and the outer surfaces of said cover channel sides

17. Apparatus as claimed in claim 5, including conveyor chain means for transporting said base card through the aforesaid channel fabricating and package assembly means, and wherein said conveyor chain includes:

shoe means mounted laterally outwardly of the links forming said conveyor chain; and track means adapted to slidably receive said shoe means to thereby control the path of travel of said conveyor chain means.

* * * * *

UNITED STATES PATENT AND TRADEMARK OFFICE

CERTIFICATE OF CORRECTION

PATENT NO. : 4,700,532

DATED : October 20, 1987

INVENTOR(S) : Sanford Redmond

It is certified that error appears in the above-identified patent and that said Letters Patent is hereby corrected as shown below:

On the title page, insert the name of the assignee: SANFORD REDMOND Inc.

In Column 1, line 41, after "pieces" and before "rectangular", insert -- of --; line 49, "Producing" should read -- producing --.

In Column 2, line 15, "bf" should read -- of --; line 54, "uniized" should read -- unitized --.

In Column 4, line 6, after "the" insert -- individual cards are then transported on a conveyor chain --.

In Column 5, line 3, after "channel-shaped" insert -- configuration. Advantageously, and as preferably embodied, --; line 47, "BRIEF DESCRIpTION" should read -- BRIEF DESCRIPTION --; line 61, after "the" insert -- bottom channel fabrication section shown in FIG. 1; --.

UNITED STATES PATENT AND TRADEMARK OFFICE

CERTIFICATE OF CORRECTION

PATENT NO. : 4,700,532

DATED : October 20, 1987

INVENTOR(S) : Sanford Redmond

It is certified that error appears in the above-identified patent and that said Letters Patent is hereby corrected as shown below:

In Column 7, line 66, "relationshio" should read -- relationship --.

In Column 12, line 14, "relative" should read -- relatively --.

In Column 16, line 10, insert a period after "sides".

Signed and Sealed this

Twenty-first Day of June, 1988

*Attest:*

DONALD J. QUIGG

*Attesting Officer*

*Commissioner of Patents and Trademarks*